US011099520B2

(12) United States Patent
Hamaya et al.

(10) Patent No.: US 11,099,520 B2
(45) Date of Patent: Aug. 24, 2021

(54) IMAGE FORMING APPARATUS EXECUTING MAINTENANCE MODE FOR DIAGNOSING CLEANING MEMBER

(71) Applicant: BROTHER KOGYO KABUSHIKI KAISHA, Nagoya (JP)

(72) Inventors: Masahito Hamaya, Nagoya (JP); Takahito Yamaji, Aisai (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/035,136

(22) Filed: Sep. 28, 2020

(65) Prior Publication Data

US 2021/0096501 A1 Apr. 1, 2021

(30) Foreign Application Priority Data

Sep. 30, 2019 (JP) ..... JP2019-178799

(51) Int. Cl.

| | |
|---|---|
| ***G03G 15/16*** | (2006.01) |
| ***G03G 21/00*** | (2006.01) |
| ***G03G 21/16*** | (2006.01) |
| ***G03G 15/00*** | (2006.01) |

(52) U.S. Cl.

CPC ..... *G03G 21/169* (2013.01); *G03G 15/168* (2013.01); *G03G 15/55* (2013.01); *G03G 15/6558* (2013.01)

(58) Field of Classification Search

CPC .. G03G 15/168; G03G 15/55; G03G 15/6558; G03G 21/0005; G03G 21/169

See application file for complete search history.

(56) References Cited

U.S. PATENT DOCUMENTS

| | | | | |
|---|---|---|---|---|
| 2009/0245829 | A1* | 10/2009 | Hamaya | G03G 15/1675 399/50 |
| 2011/0103817 | A1* | 5/2011 | Okano | G03G 21/0005 399/71 |
| 2013/0071163 | A1* | 3/2013 | Watanabe | G03G 15/0208 399/346 |
| 2016/0378053 | A1* | 12/2016 | Kamimori | G03G 21/0035 399/71 |

FOREIGN PATENT DOCUMENTS

| | | |
|---|---|---|
| JP | 2010-197770 A | 9/2010 |
| JP | 2013-160853 A | 8/2013 |

* cited by examiner

*Primary Examiner* — Sophia S Chen

(74) *Attorney, Agent, or Firm* — Merchant & Gould P.C.

(57) ABSTRACT

In an image forming apparatus, an image bearing member and a cleaning member are in contact with each other to form a collection nip. A conveyance member is in contact with the image bearing member to form a conveyance nip. The controller executes a maintenance mode including a toner supply process, an output process, and a sheet feeding process. The toner supply process supplies at least part of the image bearing member with a predetermined amount of toner. The output process controls a circuit to output the cleaning voltage to the cleaning member. The sheet feeding process controls the feeding member to start feeding the sheet so that the sheet passes the conveyance nip in coincidence with the at least part of the image bearing member passing the conveyance nip after the at least part of the image bearing member has once passed the collection nip.

14 Claims, 11 Drawing Sheets

IMAGE FORMING APPARATUS EXECUTING MAINTENANCE MODE FOR DIAGNOSING CLEANING MEMBER

CROSS REFERENCE TO RELATED APPLICATION

This application claims priority from Japanese Patent Application No. 2019-178799 filed on Sep. 30, 2019. The entire content of the priority application is incorporated herein by reference.

TECHNICAL FIELD

The present disclosure relates to an image forming apparatus provided with a cleaning member for collecting toner on an image bearing member.

BACKGROUND

There is known an image forming apparatus provided with a plurality of photosensitive drums, a belt facing the plurality of photosensitive drums, and a cleaning unit. The cleaning unit includes a cleaning roller that contacts the belt to collect matters adhering to the belt. The cleaning unit is detachably attached to a main casing of the image forming apparatus and has an electrode for supplying electricity to the cleaning roller. The main casing has a high-voltage board and a spring electrode electrically connecting the high-voltage board and the electrode of the cleaning unit.

Similarly, the image forming apparatus is also provided with a structure for electrically connecting the high-voltage board of the main casing and an electrode provided in a process cartridge. Here, the process cartridge has the photosensitive drums and is detachably attached to the main casing.

There is also a known method for inspecting electrical connection in an image forming apparatus. Specifically, the method inspects electrical connection from a high-voltage board in a main casing to an electrode provided in a member detachably attached to the main casing by using a jig dedicated for this inspection of electrical connection. The dedicated jig has a cartridge shape simulating the cleaning unit or the process cartridge, an electrode, and a test circuit connected to the electrode. In the inspection, the jig is attached to the main casing, and the test circuit of the jig is used to determine whether electric current flows from the high-voltage board to the electrode of the jig.

SUMMARY

As described above, the dedicated jig is used in the conventional method for inspecting electrical conduction. When the electrode of the jig is positioned with low accuracy for example, there may occur erroneous detection in which current does not flow from the high-voltage board to the electrode of the jig. In addition, a time is required for replacing the jig with a regular component (the cleaning unit or the process cartridge), thereby prolonging the inspection time. Further, generally, a service engineer who performs on-site inspection and maintenance for the image forming apparatus does not carry the dedicated jig. When a failure in electrical connection between the high-voltage board and the cartridge (the process cartridge, etc.) occurs on-site, the service engineer cannot perform the inspection.

It is an object of the present disclosure is to provide an image forming apparatus for which the inspection for electrical connection can be performed without use of a dedicated jig.

In order to attain the above and other objects, the disclosure provides an image forming apparatus. The image forming apparatus is provided with an image bearing member, a toner supply member, a cleaning member, a circuit, a conveyance member, a feeding member, and a controller. The image bearing member is configured to carry toner. The toner supply member is configured to supply the image bearing member with the toner. The cleaning member is configured to collect toner from the image bearing member. The image bearing member and the cleaning member are in contact with each other to form a collection nip therebetween. The circuit is configured to apply to the cleaning member a cleaning voltage having a polarity opposite to that of toner. The conveyance member is in contact with the image bearing member to form a conveyance nip to pinch and convey a sheet. The feeding member is configured to feed a sheet to the conveyance nip. The controller is configured to execute an image forming mode for forming an image on the sheet and a maintenance mode for diagnosing the cleaning member. The maintenance mode includes: a toner supply process to supply at least part of the image bearing member with a predetermined amount of toner; an output process to control the circuit to output the cleaning voltage to the cleaning member; and a sheet feeding process to control the feeding member to start feeding the sheet so that the sheet passes the conveyance nip in coincidence with the at least part of the image bearing member passing the conveyance nip after the at least part of the image bearing member has once passed the collection nip while carrying toner supplied from the supply member.

According to another aspect, the disclosure provides an image forming apparatus. The image forming apparatus includes a photosensitive drum, a developing roller, a transferring unit, a cleaning roller, a circuit, a supply mechanism, and a controller. The photosensitive drum is configured to carry toner. The developing roller is configured to supply the photosensitive drum with the toner. The transferring unit is in contact with the photosensitive drum at a transferring nip. The transferring unit is configured to transfer a toner image from the photosensitive drum to a sheet at the transferring nip. The cleaning roller is in contact with the photosensitive drum to form a collection nip. The cleaning roller is configured to collect toner from the photosensitive drum at the collection nip. The circuit is configured to apply to the cleaning roller a cleaning voltage prompting the cleaning roller to collect toner. The supply mechanism is configured to start feeding a sheet to the transferring nip. The controller is configured to execute a maintenance mode in which the controller is configured to execute: after the developing roller supplies a predetermined region of the photosensitive drum with toner, i) controlling the circuit to maintain a state where the circuit does not apply a voltage having a polarity opposite to toner to the transferring unit while the predetermined region of the photosensitive drum passes the transfer nip; after executing the controlling i), ii) controlling the circuit to apply to the cleaning roller the cleaning voltage having a polarity opposite to toner while the predetermined region of the photosensitive drum passes the collection nip; after executing the controlling ii), iii) controlling the supply mechanism to start feeding a sheet toward the transferring nip; and after executing the controlling iii), iv) controlling the circuit to apply a voltage having a polarity opposite to the toner to the transferring unit while the predetermined region of the photosensitive drum passes the transferring nip.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
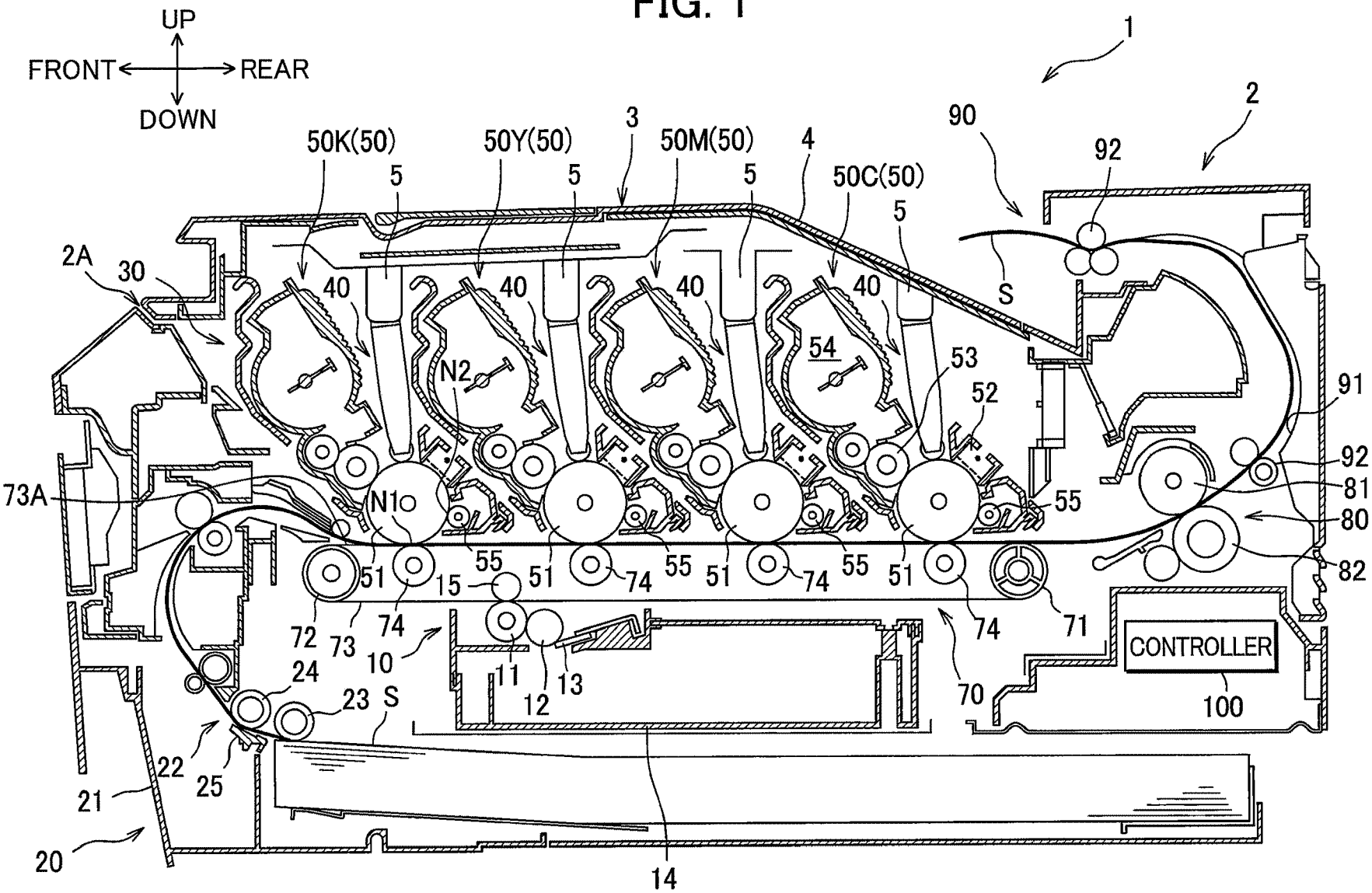
FIG. 1 is a cross section illustrating a color printer according to an embodiment.

An embodiment will be described while referring to drawings. As illustrated in FIG. 1, a color printer 1 as an example of an image forming apparatus has a main casing 2, and a supply portion 20, an image forming portion 30, a discharge portion 90, and a controller 100 which are accommodated in the main casing 2. The supply portion 20 feeds a sheet S. The image forming portion 30 forms an image on the sheet S. The discharge portion 90 discharges the sheet S on which an image is formed.

In the following description, the expressions "front", "rear", "upper", "lower", "right", and "left" are used to define the various parts when the color printer 1 is disposed in an orientation shown in FIG. 1 in which it is intended to be used.

An opening 2A is formed in the main casing 2 at an upper portion thereof. The opening 2A is opened and closed by an upper cover 3 pivotally supported by the main casing 2. The upper cover 3 has at an upper surface serving as a discharge tray 4 for storing the sheet S discharged from the main casing 2. The upper cover 3 is provided with a plurality of LED holding members 5 at a lower surface thereof. Each LED holding member 5 holds a LED unit 40.

The supply portion 20 is provided in the main casing 2 at a lower portion thereof. The supply portion 20 has a supply tray 21 detachably attached to the main casing 2 and a supply mechanism 22 that conveys the sheet S from the supply tray 21 to the image forming portion 30. The supply mechanism 22 has a pickup roller 23, a separation roller 24, and a separation pad 25.

In the supply portion 20, the sheets S in the supply tray 21 are fed by the pickup roller 23. The sheets S are then separated one by one by the separation roller 24 and separation pad 25. The separated sheet S is fed to the image forming portion 30. That is, the supply portion 20 supplies the sheet S toward a conveyance nip N1 to be described later.

The image forming portion 30 has four LED units 40, four process cartridges 50, a transfer unit 70, a belt cleaner 10, and a fixing unit 80. The process cartridges 50 and the belt cleaner 10 are detachably attached to the main casing 2.

The LED unit 40 is pivotally movably connected to the LED holding member 5. The LED unit 40 is appropriately positioned by a positioning member provided to the main casing 2 so that LED unit 40 is supported by the LED holding member 5 and the positioning member.

The process cartridges 50 are positioned between the upper cover 3 and the supply portion 20 and arranged in the front-rear direction. Each process cartridge 50 has a photosensitive drum 51 as an example of an image bearing member, a charger 52, a developing roller 53 as an example of a toner supply member, a toner chamber 54 storing toner as an example of toner, and a cleaning roller 55 as an example of a cleaning member.

The process cartridges 50 include process cartridges 50K, 50Y, 50M, and 50C using black toner, yellow toner, magenta toner, and cyan toner, respectively, arranged in this order from the upstream side in a conveying direction of the sheet S. In the present specification and drawings, characters K, Y, M, and C are appended to reference numerals of the photosensitive drums 51, the developing rollers 53, and the cleaning rollers 55 for specifying respective colors of toner, black, yellow, magenta and cyan.

The photosensitive drum 51 is a member that can carry toner thereon. Specifically, a part of the surface of the photosensitive drum 51 that is exposed by the LED unit 40 carries toner. The photosensitive drum 51 is provided in each of the plurality of process cartridges 50. The photosensitive drums 51 are arranged in a row in the conveying direction of the sheet S.

The developing roller 53 is a roller that carries toner thereon. The developing roller 53 contacts the photosensitive drum 51 to supply toner to an electrostatic latent image formed on the photosensitive drum 51.

The developing roller 53 is movable toward and away from the photosensitive drum 51. This movement can be achieved by the controller 100 controlling a contact separation mechanism (not shown). Specifically, in a color mode, all the developing rollers 53K, 53Y, 53M, and 53C contact their corresponding photosensitive drums 51K, 51Y, 51M, and 51C to supply toner thereto. In a monochrome mode, only the developing roller 53K for black contacts its corresponding photosensitive drum 51K while the developing rollers 53Y, 53M, and 53C for remaining three colors separate from their corresponding photosensitive drums 51Y, 51M, and 51C.

The cleaning roller 55 is provided for each photosensitive drum 51 so as to be adjacent to the photosensitive drum 51. The cleaning roller 55 is a member that can collect toner on the photosensitive drum 51. The cleaning roller 55 forms a collection nip N2 with the photosensitive drum 51. That is, the cleaning roller 55 and the photosensitive drum 51 contact to each other at the collection nip N2 for collecting toner on the photosensitive drum 51. The toner on the photosensitive drum 51 is collected by the cleaning roller 55 when the toner passes the collection nip N2.

The cleaning roller 55 is applied with a drum cleaning voltage as an example of a cleaning voltage. The drum cleaning voltage is a voltage with polarity opposite to that of toner. Accordingly, at least a part of toner adhering onto the photosensitive drum 51 is temporarily retained by the cleaning roller 55.

The transfer unit 70 is provided between the supply portion 20 and the process cartridges 50. The transfer unit 70 has a drive roller 71, a driven roller 72, a belt 73, and transfer rollers 74. The belt 73 is an example of a conveying member, and the transfer roller 74 is an example of a transfer member.

The drive roller 71 and the driven roller 72 are disposed in parallel spaced from each other in the front-rear direction, and an endless belt 73 is stretched tightly therebetween. The belt 73 is a member for conveying the sheet S. The belt 73 has a belt surface 73A facing and contacting each photosensitive drum 51. The belt 73 is driven by the drive roller 71 so that the belt surface 73A moves in an arrangement direction of the photosensitive drums 51. Inside a space surrounded by the belt 73, four transfer rollers 74 are arranged so as to interpose the belt together with the corresponding photosensitive drums 51. That is, the four transfer rollers 74 are arranged in the conveying direction of the sheet S. For example, at the time of printing, the transfer rollers 74 are applied with a transfer voltage having polarity opposite to that of toner.

The transfer roller 74 nips the belt 73 with the corresponding photosensitive drum 51. As a result, a conveyance nip N1 is formed between the belt 73 and each photosensitive drum 51. The belt 73 and each photosensitive drum 51 contact each other at the conveyance nip N1 to convey the sheet S. The sheet S is conveyed by the belt 73 and each photosensitive drum 51 when passing the conveyance nip N1. That is, the belt 73 can nip the sheet S with the photosensitive drums 51.

The belt cleaner 10 is a device that is in sliding contact with the belt 73 to collect toner adhering onto the belt 73. The belt cleaner 10 is disposed below the belt 73. Specifically, the belt cleaner 10 has a slide-contact roller 11, a collecting roller 12, a blade 13, and a waste toner container 14.

The slide-contact roller 11 is disposed so as to contact the outer peripheral surface of the belt 73. The slide-contact roller 11 nips the belt 73 with a backup roller 15 located inside the space surrounded by the belt 73. The slide-contact roller 11 is applied with a belt cleaning voltage having polarity opposite to that of toner to collect matters adhering onto the belt 73. Specifically, the belt cleaning voltage is applied between the backup roller 15 and the slide-contact roller 11.

The collecting roller 12 is a roller that is in sliding contact with the slide-contact roller 11 to collect matters adhering onto the slide-contact roller 11. The matters adhering onto the collecting roller 12 is scraped by the blade 13 disposed so as to be in sliding contact with the collecting roller 12 and collected into the waste toner container 14.

The fixing unit 80 has a heating roller 81 and a pressure roller 82.

According to the image forming portion 30, the surface of the photosensitive drum 51 is uniformly charged by the charger 52 and is then exposed by the LED unit 40. As a result, the potential of the exposed part decreases and an electrostatic latent image is formed on the photosensitive drum 51 based on image data. Thereafter, toner is supplied to the electrostatic latent image by the developing roller 53, and a toner image is carried on the photosensitive drum 51.

The sheet S fed onto the belt 73 passes between the photosensitive drum 51 and the transfer roller 74 disposed on the inner side of the belt 73, and the toner image formed on the photosensitive drum 51 is transferred onto the sheet S. Thereafter, the image-transferred sheet S passes between the heating roller 81 and the pressure roller 82, and the toner image on the sheet S is thermally fixed.

The discharge portion 90 has a discharge side conveying path 91 and a plurality of conveying rollers 92. The sheet S onto which the toner image has been thermally fixed is conveyed along the discharge side conveying path 91 by the conveying rollers 92, discharged outside the main casing 2, and stored in the discharge tray 4.

Figure 2:
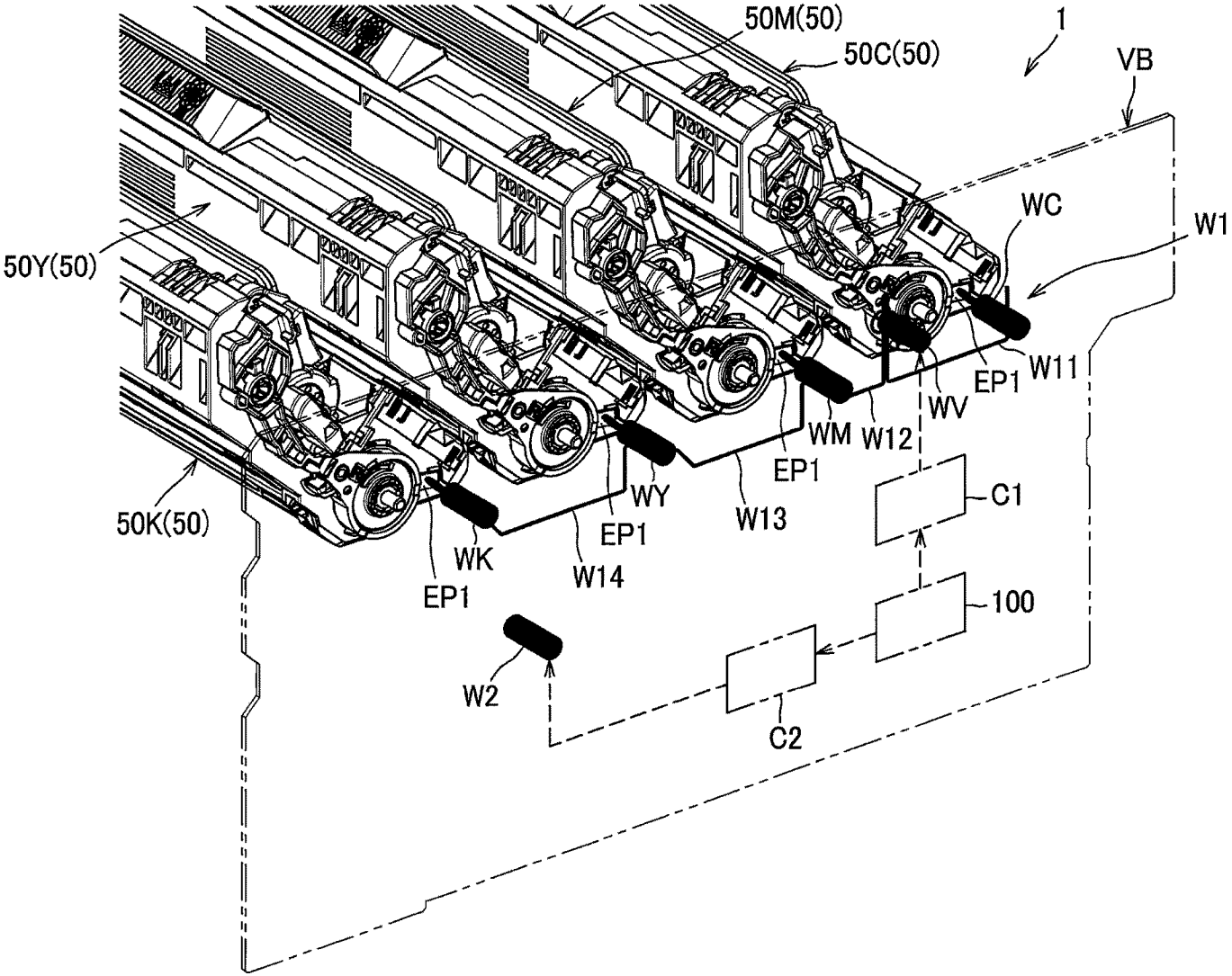
FIG. 2 is a perspective view illustrating a first wiring between a high-voltage board and process cartridges in the color printer.

As illustrated in FIG. 2, the color printer 1 further has a high-voltage board VB. The high-voltage board VB includes a controller 100, a first output circuit C1, and a second output circuit C2.

The first output circuit C1 is a circuit that can output the drum cleaning voltage to one or more cleaning rollers 55 illustrated in FIG. 1. The first output circuit C1 outputs the drum cleaning voltage upon receiving an output command of the drum cleaning voltage from the controller 100.

Each process cartridges 50 has a first electrode EP1 for transmitting the drum cleaning voltage to the corresponding cleaning roller 55. A first wiring W1 is provided between the plurality of first electrodes EP1 and the high-voltage board VB.

The first wiring W1 has a board side electrode spring WV, a first electrode spring WC, a second electrode spring WM, a third electrode spring WY, a fourth electrode spring WK, a first wire W11, a second wire W12, a third wire W13, and a fourth wire W14. The board side electrode spring WV is connected to the high-voltage board VB.

The first electrode spring WC is connected to the first electrode EP1 of the process cartridge 50C for cyan in a state where the process cartridge 50C is attached to the main casing 2. The first wire W11 connects the board side electrode spring WV and the first electrode spring WC.

The second electrode spring WM is connected to the first electrode EP1 of the process cartridge 50M for magenta in a state where the process cartridge 50M is attached to the main casing 2. The second wire W12 connects the board side electrode spring WV and the second electrode spring WM.

The third electrode spring WY is connected to the first electrode EP1 of the process cartridge 50Y for yellow in a state where the process cartridge 50Y is attached to the main casing 2. The third wire W13 connects the second electrode spring WM and the third electrode spring WY.

The fourth electrode spring WK is connected to the first electrode EP1 of the process cartridge 50K for black in a state where the process cartridge 50K is attached to the main casing 2. The fourth wire W14 connects the third electrode spring WY and the fourth electrode spring WK.

Figure 3:
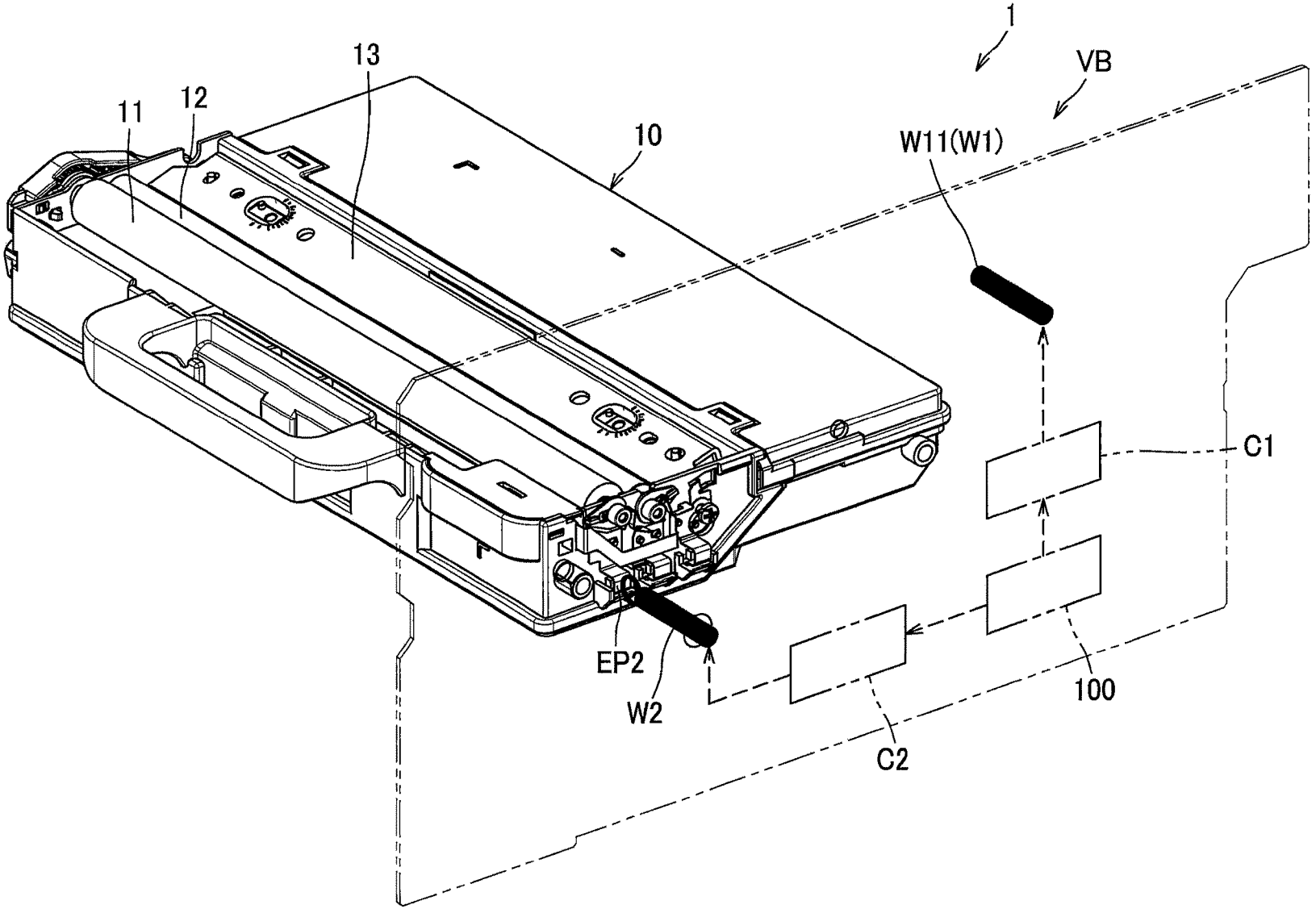
FIG. 3 is a perspective view illustrating a second wiring between the high-voltage board and a belt cleaner in the color printer.

As illustrated in FIG. 3, the second output circuit C2 is a circuit that can output the belt cleaning voltage to the slide-contact roller 11. The second output circuit C2 outputs the belt cleaning voltage upon receiving an output command of the belt cleaning voltage from the controller 100.

The belt cleaner 10 has a second electrode EP2 for transmitting the belt cleaning voltage to the slide-contact roller 11. A second wiring W2 is provided between the second electrode EP2 and the high-voltage board VB.

The second wiring W2 is constituted by one electrode spring. The second wiring W2 is connected to the high-voltage board VB. Further, the second wiring W2 is connected to the second electrode EP2 in a state where the belt cleaner 10 is attached to the main casing 2.

Although only a structure in which the voltage is applied from the high-voltage board VB to the cleaning roller 55 and slide-contact roller 11 is illustrated in FIGS. 2 and 3 for simplicity, the voltage is also applied from the high-voltage board VB to other members of the process cartridge 50, other members of the belt cleaner 10, the fixing unit 80, and etc.

The controller 100 has a CPU, a ROM, and a RAM and is configured to perform control according to a previously prepared program stored in the ROM or the RAM. Specifically, the controller 100 can execute an image forming mode for forming an image on the sheet S and a first maintenance mode for diagnosing a state (particularly, electrically conductive state or non-conductive state) of the cleaning roller 55. The controller 100 executes the image forming mode in response to reception of a print command. The controller 100 executes the first maintenance mode in response to reception of a maintenance command. The maintenance command is output from an operation panel provided on the outer surface of the main casing 2, for example.

More specifically, the maintenance command includes first to fourth commands corresponding to toner colors. The first command corresponds to black, the second command to yellow, the third command to magenta, and the fourth command to cyan. For example, when receiving the first command corresponding to black, the controller 100 diagnoses a state of the cleaning roller 55 for black in the first maintenance mode. That is, the controller 100 executes the first maintenance mode (a toner supply process, an output process, a sheet supply process, which are to be described later) for each process cartridge 50.

In the first maintenance mode, the controller 100 executes the toner supply process, the output process, and the sheet supply process. In the toner supply process according to the embodiment, the controller 100 controls the developing roller 53 to supply a predetermined amount of toner to the photosensitive drum 51. Specifically, the controller 100 executes the toner supply process by controlling the LED unit 40 to expose the surface of the photosensitive drum 51.

The range or pattern of the exposure may be set as desired. In the present embodiment, the surface of the photosensitive drum 51 is exposed over the entire width of an image forming range and over the length of one round of the photosensitive drum 51. The exposure pattern may be, for example, information indicating an abnormality or malfunction of the state of the cleaning roller 55, such as a message saying "no voltage applied to cleaning roller 55".

In the output process according to the embodiment, the controller 100 controls the first output circuit C1 to output the drum cleaning voltage to the cleaning roller 55. In the sheet supply process according to the embodiment, the controller 100 controls the supply portion 20 to start supplying the sheet S so that the sheet S passes the conveyance nip N1 at a timing when a predetermined portion of the photosensitive drum 51 to which toner has been supplied in the toner supply process passes the conveyance nip N1 after passing the collection nip N2. That is, the controller 100 controls the supply portion 20 to start feeding the sheet S so that the sheet S passes the conveyance nip N1 at a timing when the predetermined portion of the photosensitive drum 51, which has once passed the collection nip N2 while carrying toner supplied from the developing roller 53, passes the conveyance nip N1. In other words, the controller 100 controls the supply portion 20 to start feeding the sheet S so that the sheet S passes the conveyance nip N1 in accordance with the predetermined portion of the photosensitive drum 51 passing the conveyance nip N1 after the predetermined portion of the photosensitive drum 51 has once passed the collection nip N2 while carrying toner supplied from the developing roller 53. In other words, in the sheet supply process, the controller 100 controls the supply portion 20 to start supplying the sheet S so that the sheet S passes the conveyance nip N1 on or after a timing at which an exposed part of the photosensitive drum 51 passes the conveyance nip N1 the second time.

Specifically, in the first maintenance mode, the controller 100 starts supplying sheet S at a timing later than a start timing of supplying the sheet S in the image forming mode. Here, in the image forming mode, the controller 100 starts supplying the sheet S so that passes the conveyance nip N1 at a timing when the exposed part of the photosensitive drum 51 first passes the conveyance nip N1. On the other hand, in the first maintenance mode, the controller 100 starts supplying the sheet S so that the sheet S passes the conveyance nip N1 on or after a timing when the exposed part of the photosensitive drum 51, which has once passed the conveyance nip N1, passes again the conveyance nip N1.

The controller 100 has a function of applying a first transfer voltage having the same polarity as that of toner at least in a period when the toner supplied to the photosensitive drum 51 in the toner supply process is passing the conveyance nip N1. In the present embodiment, the controller 100 starts applying the first transfer voltage to the transfer roller 74 before starting the toner supply process.

The controller 100 has a function of switching the transfer voltage to be applied to the transfer roller 74 to a second transfer voltage having polarity opposite to that of toner at least in a period when the sheet S passes the conveyance nip N1. Further, the controller 100 has a function of executing a collection process in which the belt cleaner 10 collects the toner on the cleaning roller 55 through the photosensitive drum 51 and the belt 73 after the trailing edge of the sheet S passes the conveyance nip N1.

Specifically, in the collection process, the controller 100 applies a voltage having polarity the same as that of toner to the cleaning roller 55, applies the second transfer voltage to the transfer roller 74, and applies the belt cleaning voltage to the slide-contact roller 11.

The following describes operation of the controller 100. The developing rollers 53 are separated from their corresponding photosensitive drums 51 in an ordinary condition where neither the image forming mode nor first maintenance mode is executed.

Figure 4:
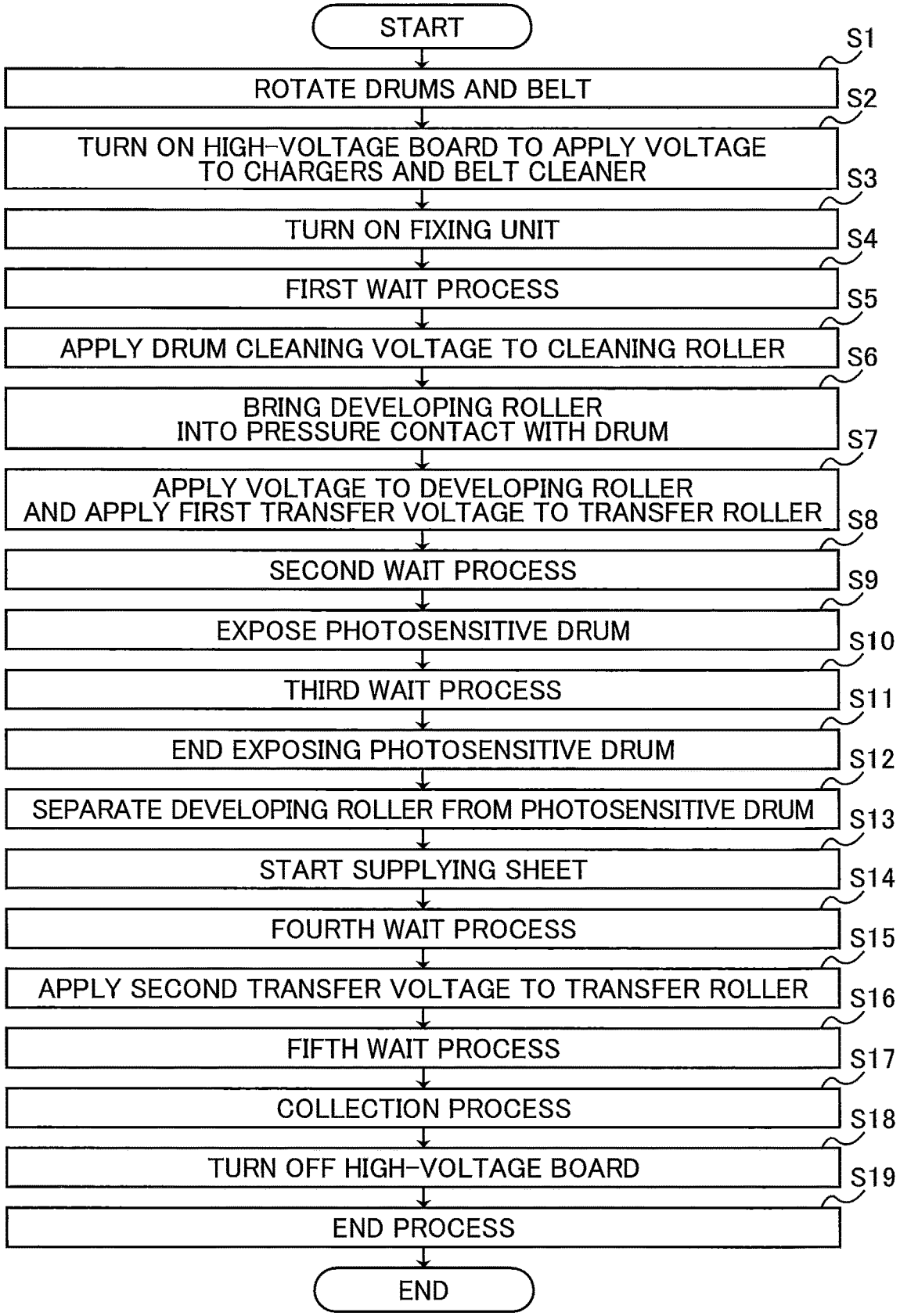
FIG. 4 is a flowchart illustrating operations of a controller executing a first maintenance mode.

The controller 100 executes the processing illustrated in FIG. 4 for each color. The following represents the operation of the controller 100 when the controller 100 receives the first command corresponding to black.

As illustrated in FIG. 4, upon receiving the first command (START), in S1 the controller 100 drives a drive source (not-shown) to rotate the photosensitive drums 51 and the belt 73.

After step S1, in S2 the controller 100 turns ON the high-voltage board VB to apply a voltage to the chargers 52 and the members 11 to 13 constituting the belt cleaner 10. After step S2, in S3 the controller 100 turns ON a heater of the fixing unit 80.

After step S3, in S4 the controller 100 executes a first wait process waiting for a first period of time. The first period of time is a time duration required for voltage values or temperature values of the high-voltage board VB, the chargers 52, the members constituting the belt cleaner 10, and the fixing unit 80 to reach their target values.

After step S4, in S5 the controller 100 controls the first output circuit C1 to output the drum cleaning voltage to the cleaning roller 55K for black. The process of S5 corresponds to the output process. After step S5, in S6 the controller 100 brings the developing roller 53K for black into pressure contact with the photosensitive drum 51K.

After step S6, in S7 the controller 100 controls the first output circuit C1 to apply a voltage having a polarity opposite to the toner to the developing roller 53K and to apply the first transfer voltage having the same polarity as that of toner to the transfer roller 74K. After step S7, in S8 the controller 100 executes a second wait process waiting for a second period of time. The second period of time is a time duration required for voltage values of the developing roller 53K and the transfer roller 74K to reach their target values.

After step S8, in S9 the controller 100 starts exposing the photosensitive drum 51K by the LED unit 40. After step S9, in S10 the controller 100 executes a third wait process waiting for a third period of time while exposing the photosensitive drum 51K. The third period of time is a time duration required for one rotation of the photosensitive drum 51K. The processes of S9 and S10 corresponds to the toner supply process.

After step S10, in S11 the controller 100 ends exposing the photosensitive drum 51K. After step S11, in S12 the controller 100 controls the developing roller 53K to separate from the photosensitive drum 51K.

After step S12, in S13 the controller 100 starts supplying the sheet S. After step S13, in S14 the controller 100 executes a fourth wait process waiting for a fourth period of time. The fourth period of time is a duration from a time when the supply of the sheet S is started to a time the leading edge of the sheet S reaches a predetermined position near and upstream of the conveyance nip N1 in the conveyance direction. After step S14, in S15 the controller 100 switches the transfer voltage to be applied to the transfer roller 74K from the first transfer voltage to the second transfer voltage having polarity opposite to that of toner.

It takes a predetermined period of time, e.g., about 40 ms to switch the transfer voltage from the first transfer voltage to the second transfer voltage. The above-mentioned fourth period of time is set so that the leading edge of the sheet S reaches the conveyance nip N1 after the transfer voltage reaches the second transfer voltage. Specifically, the fourth period of time is set as a time duration obtained by subtracting the above-mentioned predetermined period of time from a period from a time when the supply of the sheet S is started to a time when the leading edge of the sheet S reaches the conveyance nip N1.

After step S15, in S16 the controller 100 executes a fifth wait process waiting for a fifth period of time. The fifth period of time is a duration from a time when the leading edge of the sheet S reaches the conveyance nip N1 to a time when the sheet S is discharged to the discharge tray 4. The processes of S13-S16 corresponds to the sheet supply process.

After step S16, in S17 the controller 100 executes the collection process to control the belt cleaner 10 to collect the toner on the cleaning roller 55K by using the photosensitive drum 51K and the belt 73. Specifically, the controller 100 controls the first output circuit C1 to apply the voltage having the polarity the same as the toner to the cleaning roller 55K. Further, the controller 100 controls the second output circuit C2 to apply a voltage having the polarity opposite to the toner to the slide-contact roller 11. After step S17, in S18 the controller 100 turns OFF the high-voltage board VB.

After step S18, in S19 the controller 100 controls the drive source to stop the photosensitive drum 51 to end this process.

Next, operations and effects of the first maintenance mode will be described.

Figure 5A:
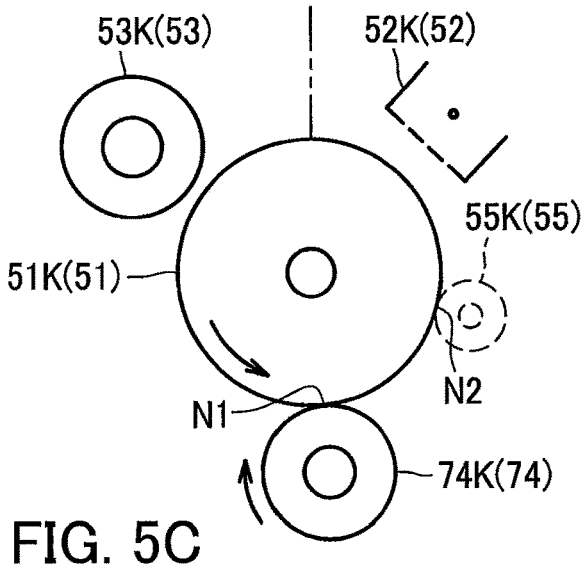
FIGS. 5A-5F are explanatory diagrams illustrating the first maintenance mode from its start to a time when toner on a photosensitive drum passes a conveyance nip.

As illustrated in FIG. 5A, the controller 100 rotates the photosensitive drums 51 in response to the first command. In FIGS. 5A to 5F and FIGS. 6A to 6E, the belt 73 is omitted for simplicity. Further, the two-dot chain straight line denotes the exposure position. The rotation direction of rollers such as the developing roller 53 is omitted for simplicity.

Figure 5B:
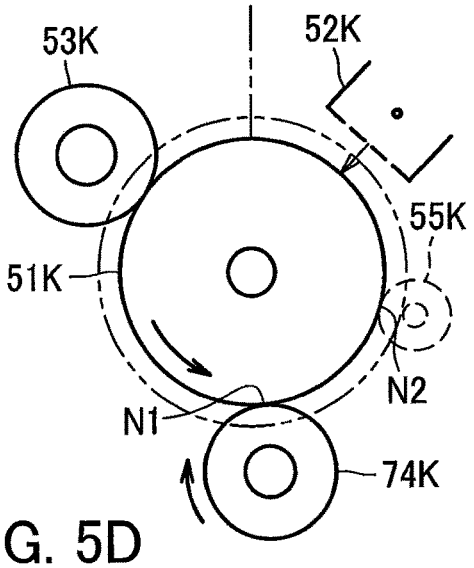

As illustrated in FIG. 5B, when the controller 100 executes the processes of S2-S4, the entire circumference of the photosensitive drum 51K is charged by the charger 52K. In FIGS. 5A to 5F and FIGS. 6A to 6E, the two-dot chain circle along the surface of the photosensitive drum 51K denotes a surface potential.

If there is a malfunction of electrical connection from the first output circuit C1 to the cleaning roller 55K, such as disconnection in the first wiring W1 when S5 is executed, the drum cleaning voltage is not applied to the cleaning roller 55K. The dashed circle denotes the cleaning roller 55K that is not applied with the drum cleaning voltage due to the malfunction in FIGS. 5A-6E.

Figure 5C:
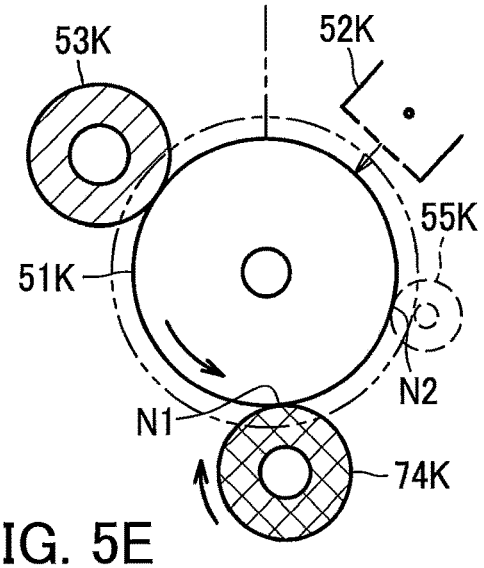

When the controller 100 executes the processes of S6 to S8, as illustrated in FIGS. 5B and 5C the developing roller 53K is brought into pressure contact with the photosensitive drum 51K, and a voltage is applied to the developing roller 53K. The transfer roller 74K is applied with the first transfer voltage having polarity opposite to that during printing. That is, the transfer roller 74K is applied with the first transfer voltage having the polarity the same as the toner. In FIGS. 5A-6E, members that is applied with a voltage having the same polarity as that during printing is obliquely hatched, and members that is applied with a voltage having polarity opposite to that during printing is hatched in a lattice pattern.

Figure 5D:
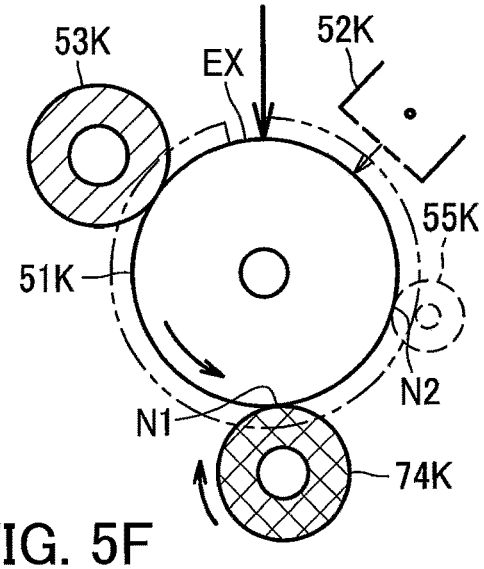
Figure 5E:
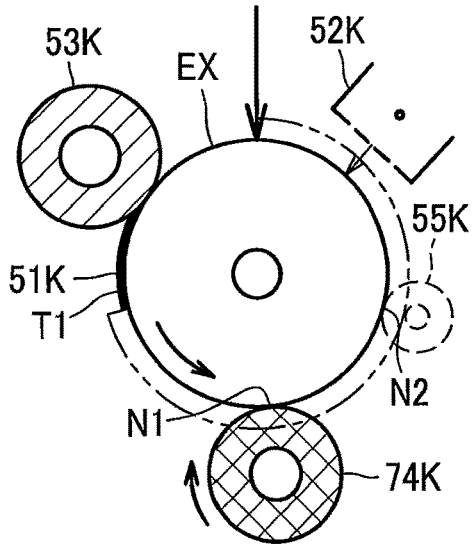

When the controller 100 executes the process of S9, the surface of the photosensitive drum 51K is exposed as illustrated by the arrow in FIG. 5D. When an exposed part EX on the photosensitive drum 51K passes the developing roller 53K as illustrated in FIG. 5E, toner T1 is supplied to the exposed part EX.

Figure 5F:
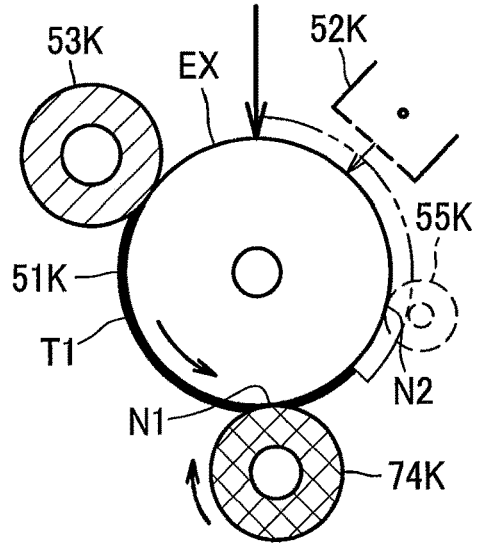

As illustrated in FIG. 5F, the toner T1 on the exposed part EX passes the conveyance nip N1. At this time, the first transfer voltage is applied to the transfer roller 74K, so that the toner T1 is kept carried on the photosensitive drum 51K without moving toward the transfer roller 74K.

Figure 6A:
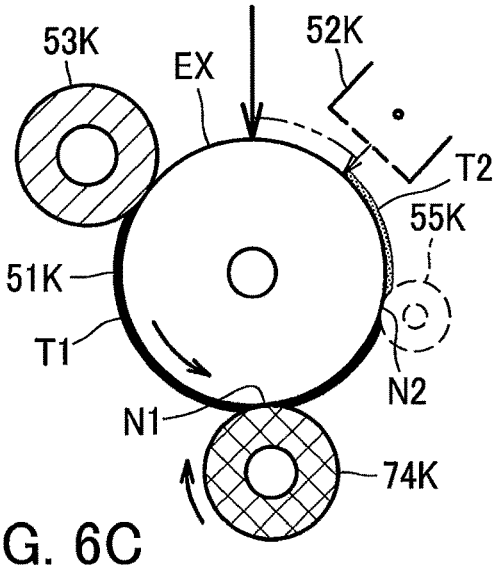
FIGS. 6A-6E are explanatory diagrams illustrating the first maintenance mode from a time when the toner on the photosensitive drum passes a collection nip to a time when the toner is transferred to a sheet.

Thereafter, as illustrated in FIG. 6A, the toner T1 passes the collection nip N2. In FIGS. 6A-6E, the toner (toner T2) after passing the collection nip N2 is hatched in a pattern different from that of the toner (toner T1) before passing the collection nip N2.

In a case where the drum cleaning voltage is applied to the cleaning roller 55K, the toner T1 after passing the conveyance nip N1 is collected by the cleaning roller 55K. However, in a case where the drum cleaning voltage is not applied to the cleaning roller 55K due to some malfunction, the toner T1 after passing the conveyance nip N1 passes the collection nip N2 without being collected by the cleaning roller 55K.

Figure 6B:
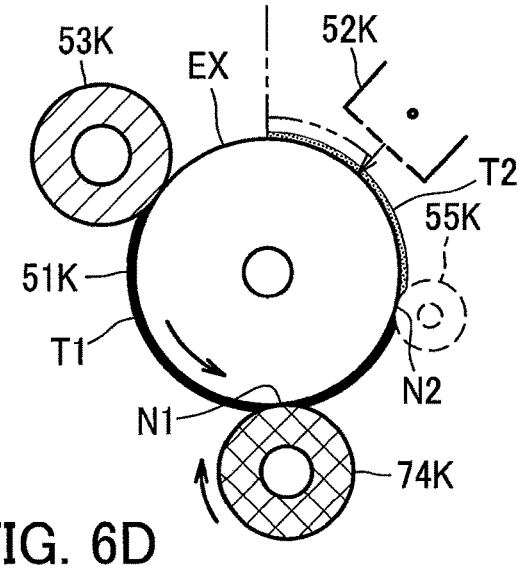
Figure 6C:
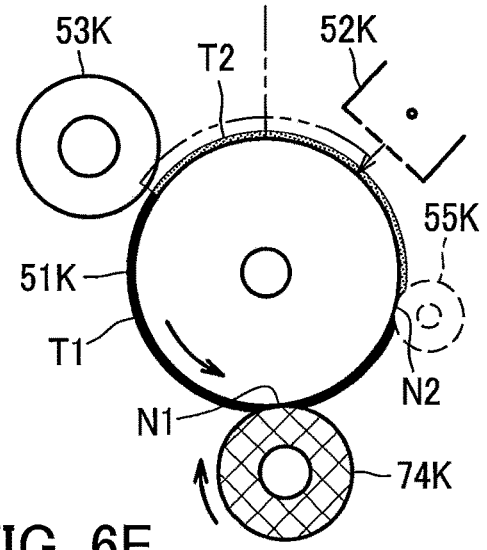

When the photosensitive drum 51K makes one rotation from the time when the exposure is started, the controller 100 ends the exposure as illustrated in FIG. 6B (S10, S11). Thereafter, when the controller 100 executes the processes of S12-S14, as illustrated in FIG. 6C the developing roller 53K is separated from the photosensitive drum 51K and subsequently supply of the sheet S is started.

Figure 6D:
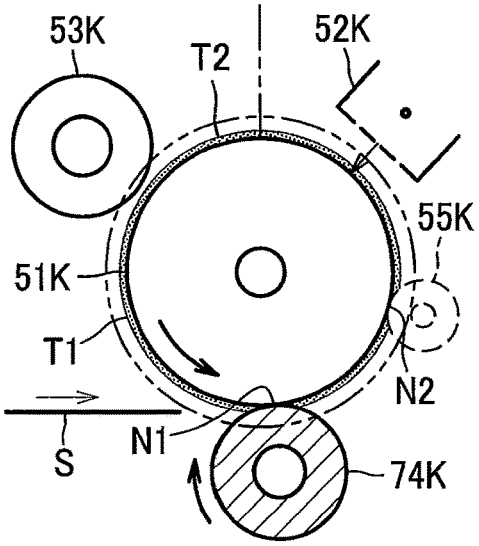

The photosensitive drum 51K makes one rotation or more until the leading edge of the sheet S reaches the conveyance nip N1 so that the toner on the photosensitive drum 51K entirely passes the collection nip N2 and thus is denoted as the toner T2 in FIG. 6D. When the leading edge of the sheet S reaches the predetermined position near and upstream of the conveyance nip N1, the controller 100 switches the transfer voltage to be applied to the transfer roller 74K to the second transfer voltage having the same polarity as that during printing (S15).

Figure 6E:
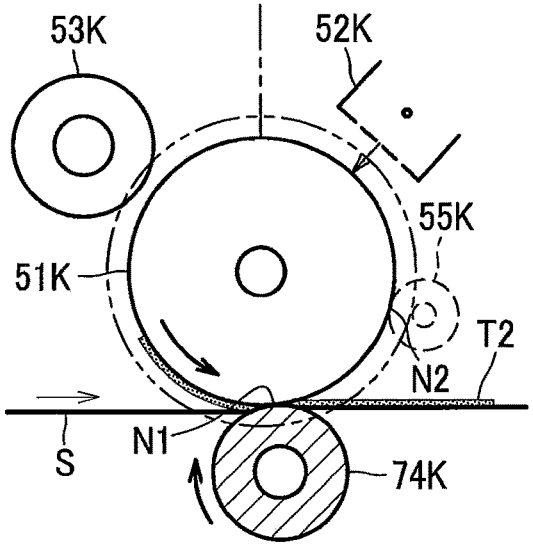

Thereafter, as illustrated in FIG. 6E, when the leading edge of the sheet S passes the conveyance nip N1, the toner T2 on the photosensitive drum 51K is transferred onto the sheet S. Then, the controller 100 executes the process of step S16, and the sheet S onto which the toner T2 has been transferred is discharged to the discharge tray 4. In a case where electrical connection to the cleaning roller 55K is properly established, the toner (toner T1) before passing the collection nip N2 is collected by the cleaning roller 55K as illustrated in FIG. 5F. Thus, no toner is transferred onto the subsequently conveyed sheet S. In this case, a clean sheet S onto which no toner has been transferred is discharged to the discharge tray 4.

As described above, the embodiment has the following advantages.

A user executes the first maintenance mode and checks adhesion of toner onto the sheet S discharged to the discharge tray 4 and can thereby find whether there is a malfunction in electrical connection to the cleaning roller 55K from the first output circuit C1. In such an election connection test, occurrence of the malfunction is determined depending on the presence or absence of toner adhered on the sheet S, and the use of a dedicated jig for the test is not necessary whereby problems concerning the test jig can be avoided.

The first transfer voltage is applied to the transfer roller 74K while the toner T1 supplied to the photosensitive drum 51K in the toner supply process is passing the conveyance nip N1. Accordingly, the toner T1 can be suppressed from adhering onto the belt 73. In particular, in the present embodiment, application of the first transfer voltage to the transfer roller 74K is started before the toner supply process is started. Accordingly, the toner T1 can be further suppressed from adhering to the belt 73 as compared to a case where application of the first transfer voltage is started after the toner supply process is started, for example.

The transfer voltage applied to the transfer roller 74K is changed to the second transfer voltage having polarity opposite to that of toner at least in a period in which the sheet S passes the conveyance nip N1. Accordingly, the toner on the photosensitive drum 51K can be transferred onto the sheet S reliably. It should be noted that the present invention is not limited to the above configuration, but the transfer voltage may not necessarily be applied to the transfer roller 74K at least in a period in which the sheet S passes the conveyance nip N1. Even in this case, the toner on the photosensitive drum 51K can be transferred onto the sheet S by a pressure by the nip between the photosensitive drum 51K and the transfer roller 74K.

The collection process is executed after the sheet S passes the conveyance nip N1. In a case where the cleaning voltage is normally applied to the cleaning roller 55K, the toner is once collected by the cleaning roller 55K. Thereafter, the collected toner can be discharged onto the photosensitive drum 51K from the cleaning roller 55K and then collected by the belt cleaner 10, whereby a preparation time for subsequent printing operation can be shortened.

The first maintenance mode is executed for each process cartridge 50. Accordingly, any process cartridges 50 having malfunction in electrical connection to the cleaning roller 55 from the first output circuit C1 can be identified.

While the disclosure has been described in detail with reference to the specific embodiment thereof, it would be apparent to those skilled in the art that various changes and modifications may be made therein without departing from the scope of the invention. In the following description, like parts and components are designated with the same reference numerals to avoid duplicating description.

Figure 8A:
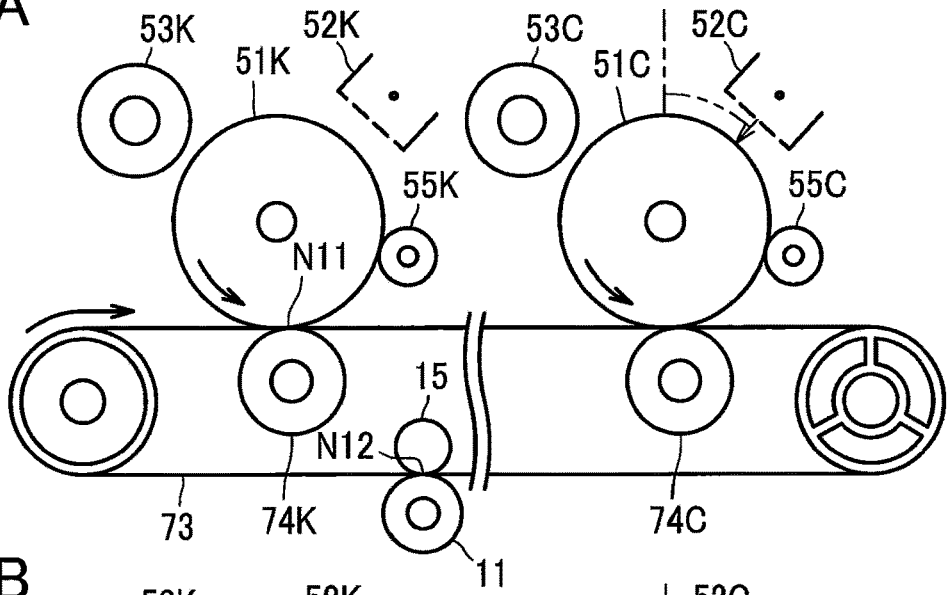
FIGS. 8A-8C are explanatory diagrams illustrating the second maintenance mode from its start to a time before exposure of a photosensitive drum is started.

In the above described embodiment, the cleaning roller 55 as a cleaning member is a target for determining existence of malfunction in electrical connection. However, the cleaning member as the target for determination may be the slide-contact roller 11 for example. In this case, the controller 100 executes a second maintenance mode for testing electrical connection to the slide-contact roller 11 from the second output circuit C2. Specifically, the controller 100 receives a second maintenance command output from an operation panel for example, and executes the second maintenance mode based on the second maintenance command. In this configuration, as illustrated in FIG. 8A, the belt 73 is an example of an image bearing member, the photosensitive drum 51C positioned most downstream among the photosensitive drums 51 in the conveying direction of the sheet S is an example of a toner supply member, and the photosensitive drum 51K positioned most upstream among the photosensitive drums 51 in the conveying direction is an example of a conveying member. As illustrated in FIG. 8A, a conveyance nip between the most upstream side photosensitive drum 51K and the belt 73 is denoted by "N11", and a nip between the belt 73 and the slide-contact roller 11 is denoted by "N12".

In this configuration, the controller 100 executes a toner supply process in which the most downstream side photosensitive drum 51C and the transfer roller 74C supply toner from the photosensitive drum 51C to the belt 73. Further, the controller 100 executes a sheet supply process based on the conveyance nip N11 between the most upstream side photosensitive drum 51K and the belt 73. Specifically, in the sheet supply process, the controller 100 starts supplying the sheet S so that the sheet S passes the conveyance nip N11 on the most upstream side photosensitive drum 51K at a timing when a predetermined portion of the belt 73, which has once passed the collection nip N12 with carrying toner supplied from the most downstream side photosensitive drum 51C, passes the conveyance nip N11. That is, the controller 100 starts supplying the sheet S so that the sheet S passes the conveyance nip N11 in accordance with the predetermined portion of the belt 73 passes the conveyance nip N11 after the predetermined portion of the belt 73 once passed the collection nip N12 with carrying toner supplied from the most downstream side photosensitive drum 51C. The second maintenance mode will be described while referring to FIGS. 7-11

Figure 7:
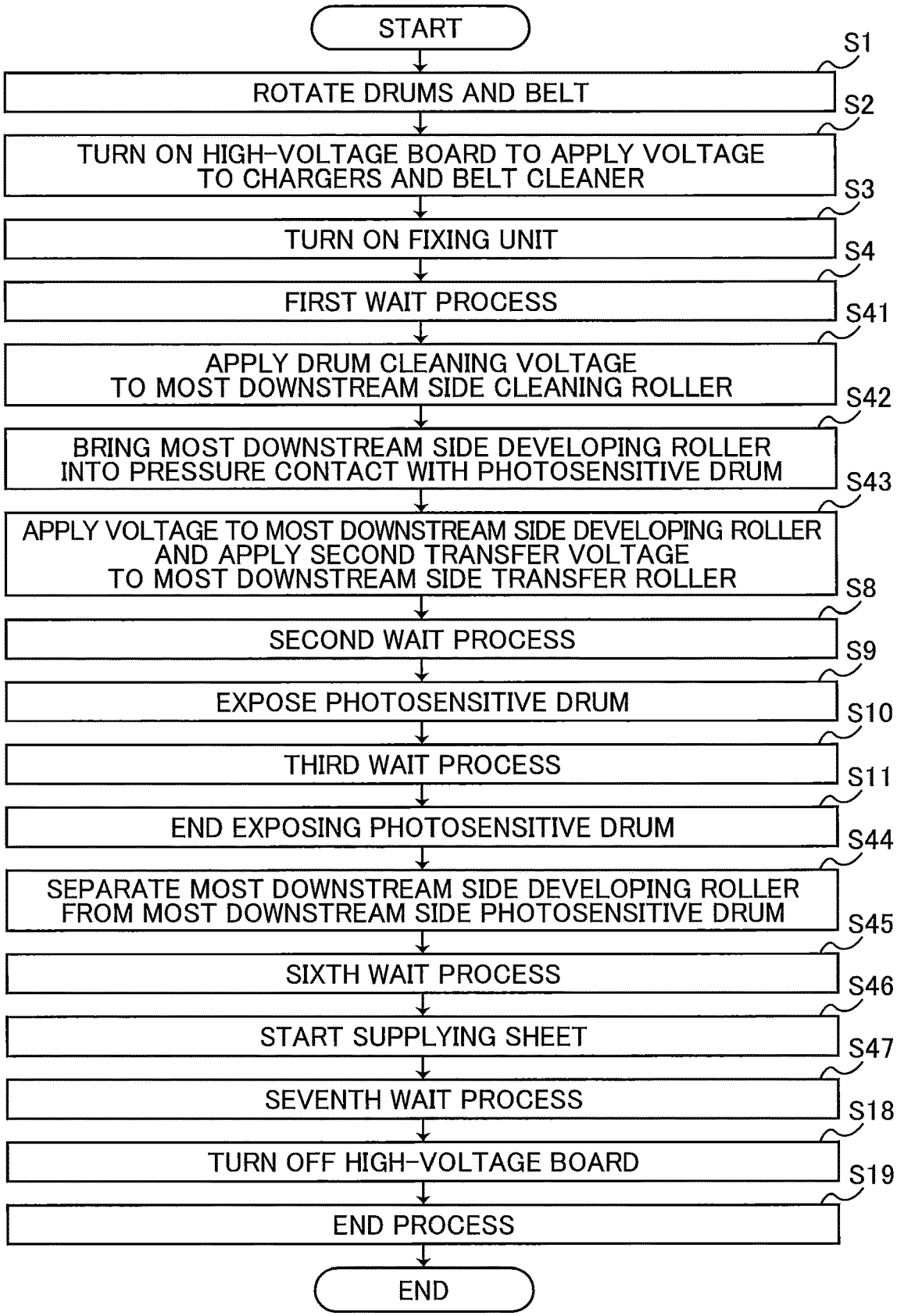
FIG. 7 is a flowchart illustrating operations of the controller executing a second maintenance mode.

As illustrated in FIG. 7, in response to reception of the second maintenance command (START), the controller 100 executes the same processes as S1 to S4 described above.

The process of S2 corresponds to the output process according to the second maintenance mode. After step S4, in S41 the controller 100 applies the drum cleaning voltage to the most downstream side cleaning roller 55C.

After step S41, in S42 the controller 100 brings the most downstream side developing roller 53C into pressure contact with the most downstream side photosensitive drum 51C. After step S42, in S43 the controller 100 controls the first output circuit C1 to apply a voltage having polarity opposite to the toner to the most downstream side developing roller 53C and applies the second transfer voltage having the same polarity as that during printing to the most downstream side transfer roller 74C.

After step S43, the controller 100 executes the same processes as those in S8-S11 described above. Specifically, the controller 100 exposes the most downstream side photosensitive drum 51C in steps S9 to S11. In the processes of S9-S11, the toner on the photosensitive drum 51C is transferred to the belt 73.

After step S11, in S44 the controller 100 separates the most downstream side developing roller 53C from the photosensitive drum 51C. After step S44, in S45 the controller 100 executes a sixth wait process waiting for a sixth period of time. After step S45, in S46 the controller 100 starts supplying the sheet S. That is, the sixth period of time is a time duration from a time when the developing roller 53C is separated from the photosensitive drum 51C to a time when the supply of the sheet S is started. In other words, the start time of supplying the sheet S is set by the sixth period of time so that the leading edge of the sheet S reaches the conveyance nip N11 before the leading edge of the toner transferred onto the belt 73 reaches the conveyance nip N11.

After step S46, in S47 the controller 100 executes a seventh wait process waiting for a seventh period of time. The seventh time is a time duration from a time when the supply of the sheet S is started to a time when the sheet S is discharged to the discharge tray 4. The processes of S46 and S47 correspond to the sheet supply process according to the second maintenance mode. Further, the process of S47 corresponds to the toner supply process according to the second maintenance mode.

After step S47, the controller 100 executes the same processes as those in S18 and S19 described above to end the process.

Operations and effects of the second maintenance mode will be described.

As illustrated in FIG. 8A, the controller 100 rotates the photosensitive drums 51 based on the second maintenance command. The indicators (lines, arrows, hatching, etc.) used in FIG. 8A to FIG. 11 are the same as those used in the above embodiment (FIGS. 5A-6E).

Figure 8B:
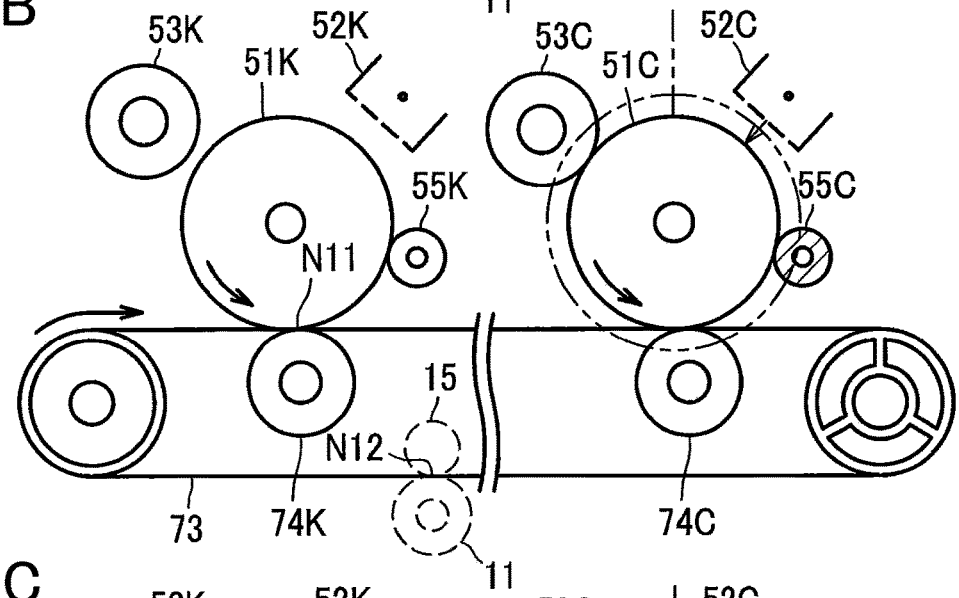

As illustrated in FIGS. 8A and 8B, when the controller 100 executes the processes of S2-S4, the entire circumference of the photosensitive drum 51C is charged by the most downstream charger 52C, and the belt cleaning voltage is output from the second output circuit C2 to the slide-contact roller 11. If there is a malfunction in electrical connection from the second output circuit C2 to the slide-contact roller 11 such as electrical disconnection between the second wiring W2 and the high-voltage board VB, the belt cleaning voltage is not applied to the slide-contact roller 11.

Figure 8C:
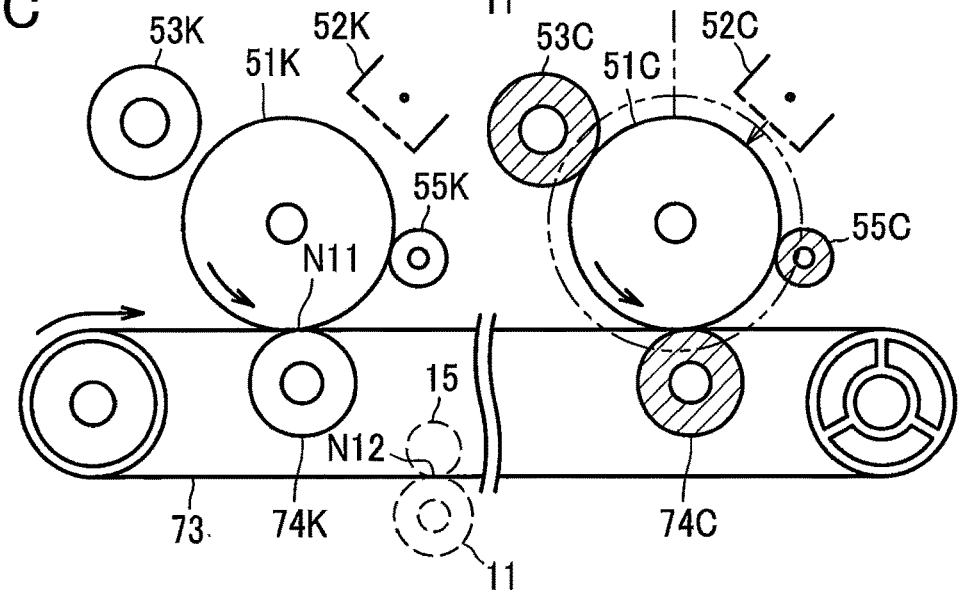

When the controller 100 executes the processes of S41-S43, voltage application to the most downstream side cleaning roller 55C, developing roller 53C, and transfer roller 74C, and pressure contact of the most downstream side developing roller 53C to the photosensitive drum 51C are performed, as illustrated in FIGS. 8B and 8C. The voltage applied to the most downstream side cleaning roller 55C, developing roller 53C, and transfer roller 74C has the same polarity as that during printing.

Figure 9A:
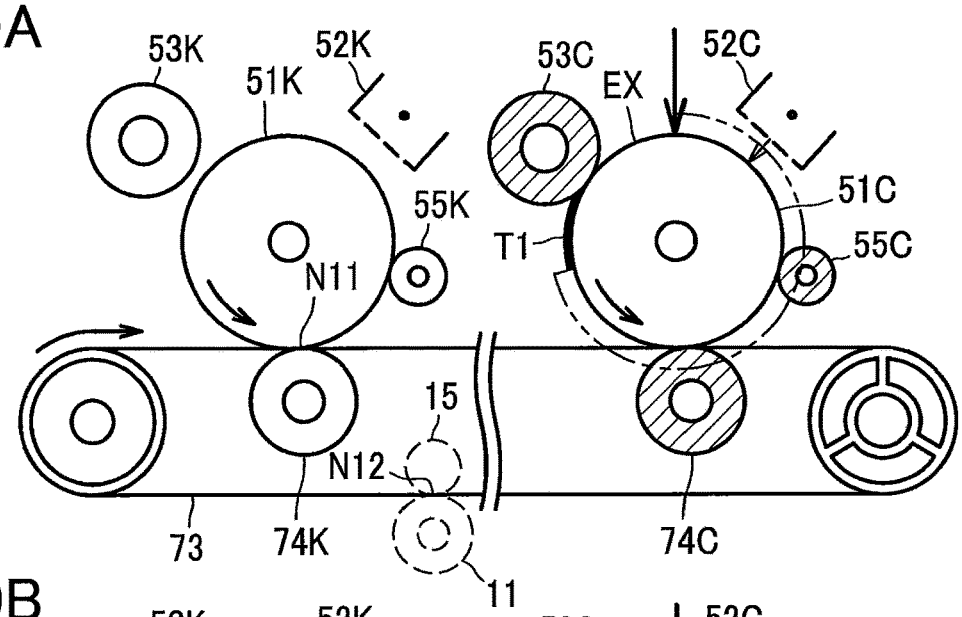
FIGS. 9A-9C are explanatory diagrams illustrating the second maintenance mode from a time when exposure of the photosensitive drum is started to a time when the exposure is ended.

When the controller 100 executes the process of S9, the surface of the most downstream side photosensitive drum 51C is exposed as illustrated in FIG. 9A. When the exposed part EX on the photosensitive drum 51C passes the developing roller 53C, the toner T1 is supplied to the exposed part EX.

Figure 9B:
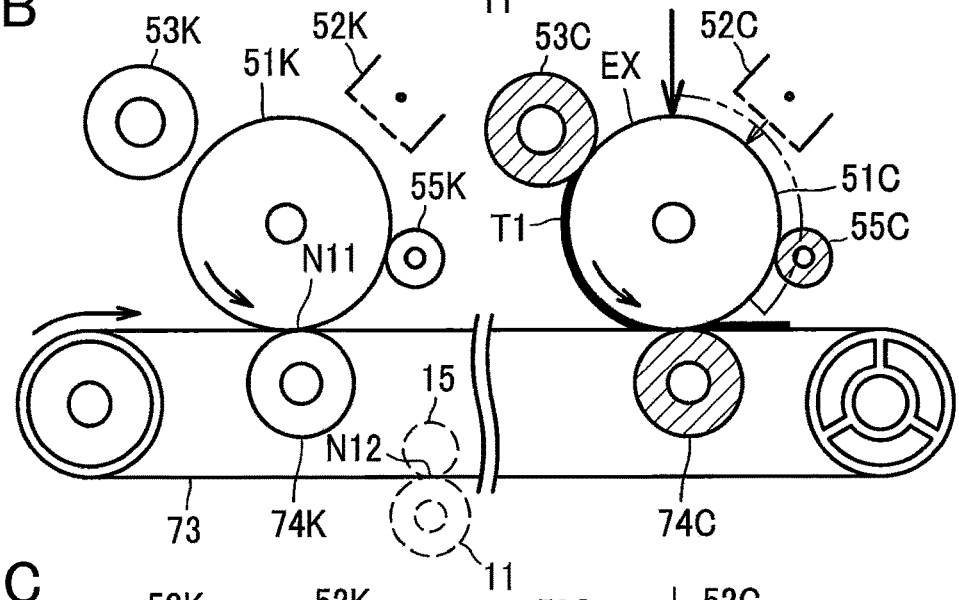
Figure 9C:
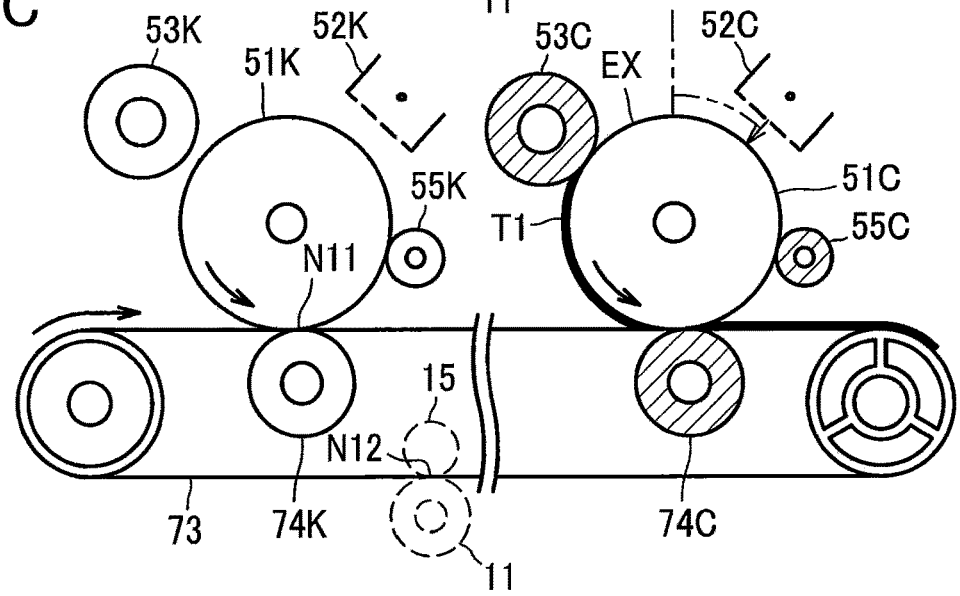

As illustrated in FIG. 9B, when the toner T1 on the exposed part EX reaches the most downstream side transfer roller 74C, the toner T1 is transferred onto the belt 73. When the photosensitive drum 51C makes one rotation from the time when the exposure is started, the controller 100 ends the exposure as illustrated in FIG. 9C (S10, S11).

Figure 10A:
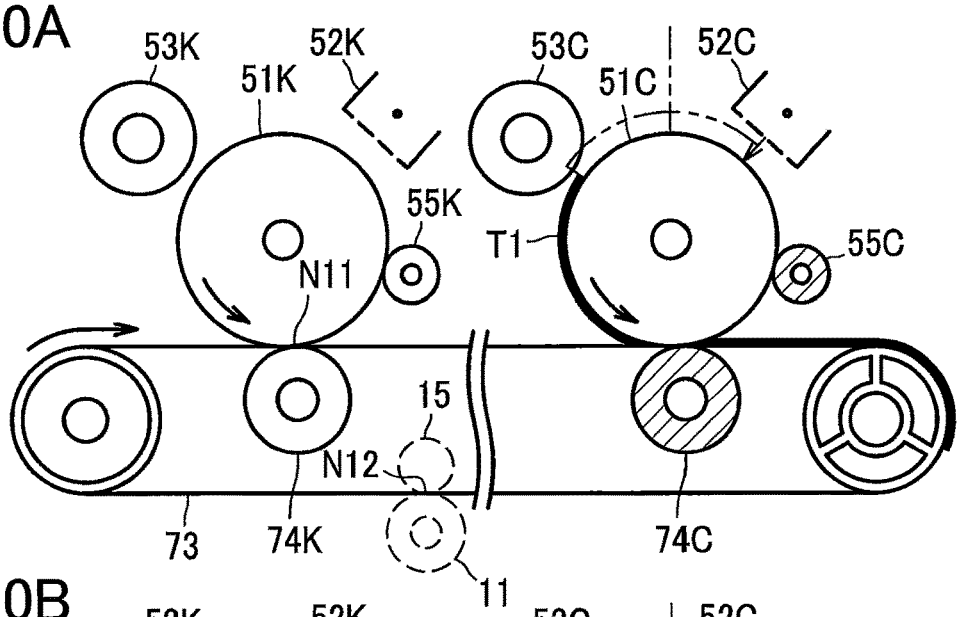
FIGS. 10A-10C are explanatory diagrams illustrating the second maintenance mode from a time when a developing roller separates from the photosensitive drum and a time when a sheet reaches a position near and upstream of a conveyance nip in a conveyance direction.

Thereafter, as illustrated in FIG. 10A, the controller 100 separates the developing roller 53C from the photosensitive drum 51C (S44) and then starts supplying the sheet S at a predetermined timing (S45, S46).

Figure 10B:
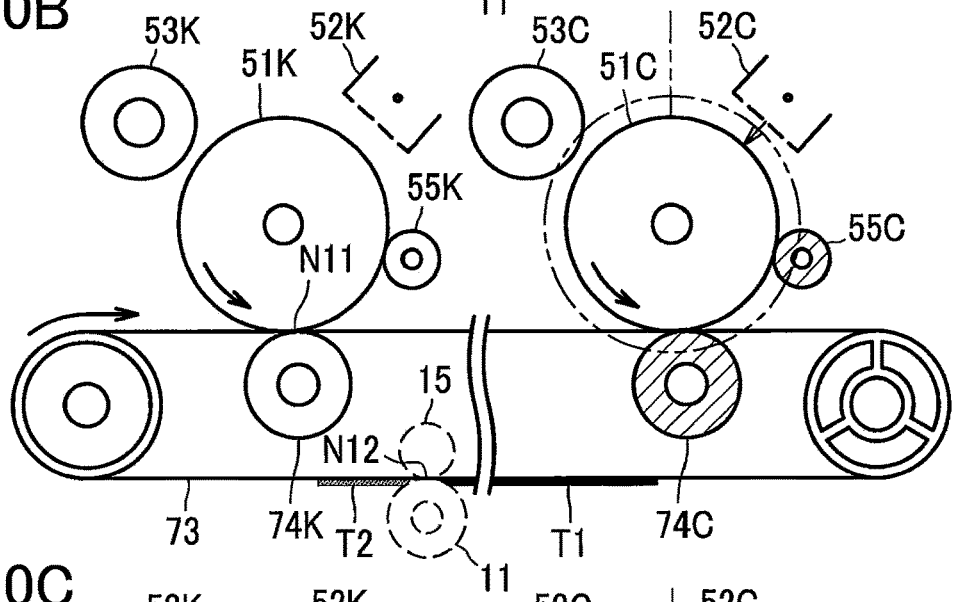

Thereafter, the toner T1 on the belt 73 passes the collection nip N12 as illustrated in FIG. 10B. In a case where the belt cleaning voltage is applied to the slide-contact roller 11, the toner T1 on the belt 73 is collected by the slide-contact roller 11. However, in a case where the belt cleaning voltage is not applied to the slide-contact roller 11 due to some malfunction, the toner T1 on the belt 73 passes the collection nip N12 without being collected by the slide-contact roller 11. As in the above embodiment, the toner after passing the collection nip N12 is referred to as the toner T2.

Figure 10C:
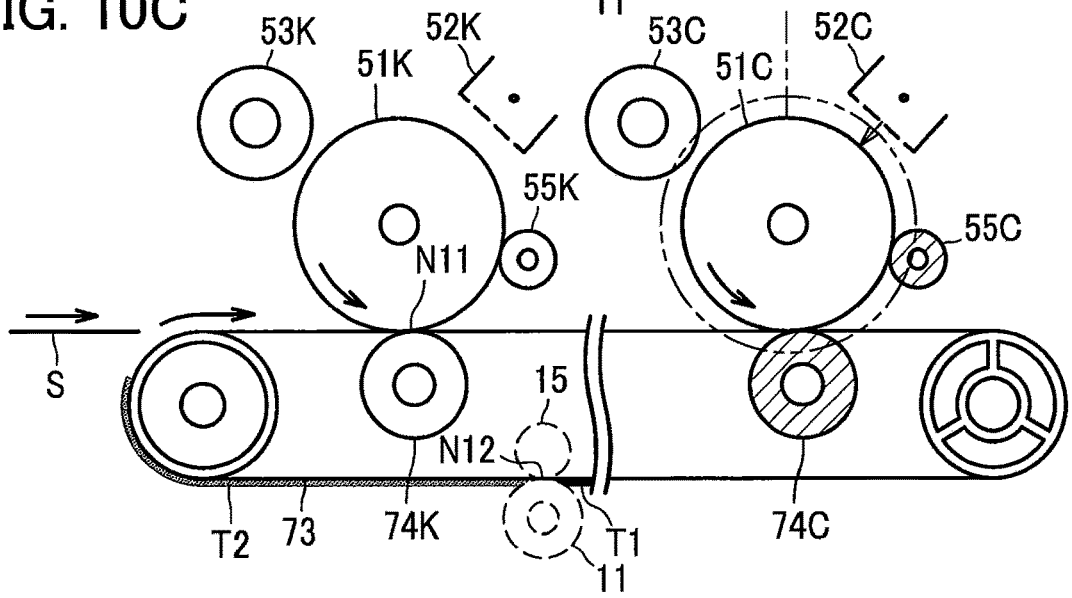
Figure 11:
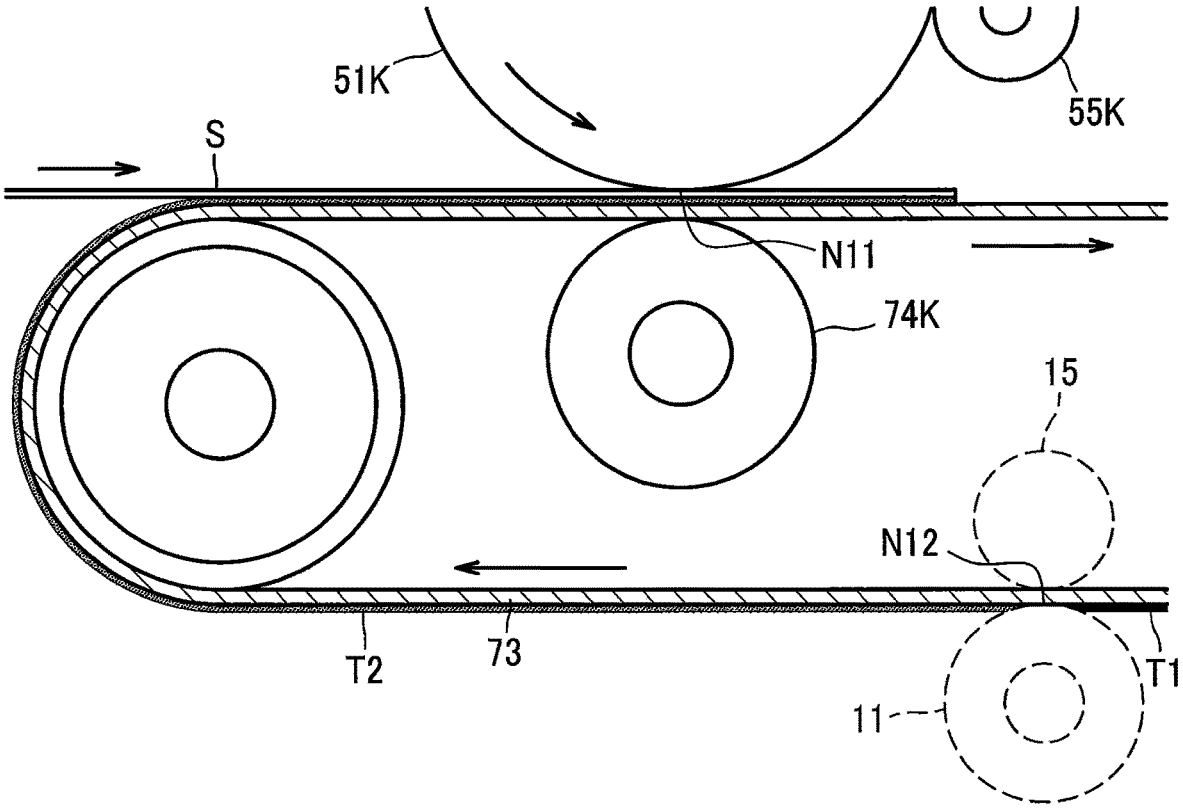
FIG. 11 is an explanatory diagram illustrating a state where the toner on the belt is transferred to the sheet in the second maintenance mode.

Thereafter, as illustrated in FIGS. 10C and 11, when the toner T2 after passing the collection nip N12 reaches the conveyance nip N11 together with the sheet S, the toner T2 is transferred onto the back surface of the sheet S (the surface of the sheet S opposite to the surface facing the photosensitive drum 51K) by a nip pressure applied at the conveyance nip N11.

Then, the controller 100 executes the process of S47, and the sheet S onto which the toner T2 has been transferred is discharged to the discharge tray 4. When electrical connection from the second output circuit C2 to the slide-contact roller 11 is properly established, the toner (toner T1 shown in FIG. 10A) before passing the collection nip N12 is collected by the slide-contact roller 11. Accordingly, no toner is transferred onto the back surfaces of subsequently conveyed sheets S. Thus, in this case, a clean sheet S onto which no toner has been transferred is discharged to the discharge tray 4.

As described above, in this configuration, a user can find whether there is malfunction in electrical connection from the second output circuit C2 to the slide-contact roller 11 by checking adhesion of toner onto the sheet S discharged to the discharge tray 4.

Further, in this configuration, the toner supply process is performed by the most downstream side photosensitive drum 51C and transfer roller 74C. Accordingly, toner on the belt 73 can be prevented from adhering to other photosensitive drums 51.

While the toner T2 is transferred onto the back surface of the sheet S by a nip pressure applied at the conveyance nip N11 in this configuration, the present invention is not limited to this. For example, the controller 100 may apply a transfer voltage having the same polarity as that of toner to the transfer roller 74K at least in a time period in which the sheet S passes the conveyance nip N11. Accordingly, the toner on the belt 73 is reliably transferred onto the sheet S.

Although the most downstream side photosensitive drum 51C and the most upstream side photosensitive drum 51K are used in the second maintenance mode, the present invention is not limited to this. For example, only the most upstream side photosensitive drum 51K may be used in the second maintenance mode. Specifically, in this case, the toner supply process may be performed using the most upstream side photosensitive drum 51K, and the sheet supply process may be performed based on the conveyance nip N11 in the most upstream side photosensitive drum 51K. Alternatively, the second maintenance mode may be executed using the most upstream side photosensitive drum 51K and one of the photosensitive drums 51Y and 51M which is positioned between the most downstream side photosensitive drum 51C and the most upstream side photosensitive drum 51K.

The controller 100 may be configured to execute both the first maintenance mode and the second maintenance mode.

While the cleaning roller 55 is provided for all the process cartridges 50 in the above embodiment, the present invention is not limited this, and the cleaning roller 55 may be provided only for two process cartridges 50. In this case, the toner supply process, the output process, and the sheet supply process may be performed for each process cartridge corresponding to the cleaning roller.

While in S14 the fourth period of time is set as a time duration from a time when the supply of the sheet S is started to a time when the leading edge of the sheet S reaches a predetermined position immediately near and upstream of the conveyance nip N1 in the conveyance direction in the above embodiment, the present invention is not limited to this. The fourth period of time may be set to a time duration equal to or longer than a time duration from a time when which the supply of the sheet S is started and a time when the leading edge of the sheet S reaches the conveyance nip N1.

While the exposure time (the third period of time in S10) in the first or second maintenance mode is set to a period of time corresponding to one rotation of the photosensitive drum 51 in the above embodiment, the present invention is not limited to this, and the exposure time may be set to a time duration shorter than a time duration worth of one rotation of the photosensitive drum 51.

In the embodiments, the color printer 1 is used as an example. However, the present invention is not limited to this. Other type image forming apparatus can be applied to the above techniques, such as a monochromatic printer, a copier machine, and a multifunction peripheral.

Components, steps, and processes described in the above described embodiments and modifications can be arbitrary combined.

What is claimed is:

1. An image forming apparatus comprising:

an image bearing member configured to carry toner;

a toner supply member configured to supply the image bearing member with the toner;

a cleaning member configured to collect toner from the image bearing member, the image bearing member and the cleaning member being in contact with each other to form a collection nip therebetween;

a circuit configured to apply to the cleaning member a cleaning voltage having a polarity opposite to that of toner;

a conveyance member in contact with the image bearing member to form a conveyance nip to pinch and convey a sheet;

a feeding member configured to feed a sheet to the conveyance nip; and a controller configured to execute an image forming mode for forming an image on the sheet and a maintenance mode for diagnosing the cleaning member, wherein the maintenance mode includes:

a toner supply process to supply at least part of the image bearing member with a predetermined amount of toner;

an output process to control the circuit to output the cleaning voltage to the cleaning member; and a sheet feeding process to control the feeding member to start feeding the sheet so that the sheet passes the conveyance nip in coincidence with the at least part of the image bearing member passing the conveyance nip after the at least part of the image bearing member has once passed the collection nip while carrying toner supplied from the supply member.

2. The image forming apparatus according to claim 1, wherein the image bearing member includes a photosensitive drum configured to carry toner thereon, the toner supply member includes a developing roller configured to supply the photosensitive drum with toner, and the conveyance member includes a transfer member configured to make toner on the photosensitive drum transfer to the sheet.

3. The image forming apparatus according to claim 2, wherein the controller is configured to further perform an application process to apply a voltage having a polarity same as that of toner to the transfer member at least in a period of time in which toner carried on the photosensitive drum passes the conveyance nip in toner apply process.

4. The image forming apparatus according to claim 3, wherein the application process is started before toner supply process is started.

5. The image forming apparatus according to claim 2, wherein the controller is configured to further perform an application process to apply a transferring voltage having a polarity opposite to that of toner to the transfer member at least in a period of time in which the sheet passes the conveyance nip.

6. The image forming apparatus according to claim 2, wherein the image bearing member includes a plurality of photosensitive drums configured to carry toner thereon, the plurality of photosensitive drums being arranged in a conveyance direction in which the sheet is conveyed, wherein the transfer member includes:

an endless belt configured to convey the sheet; and a plurality of transfer rollers being arranged in the conveyance direction, the plurality of transfer rollers corresponding to respective ones of the plurality of photosensitive drums and pinching the endless belt with respective ones of the plurality of photosensitive drums.

7. The image forming apparatus according to claim 6, further comprising a belt cleaner configured to collect toner on the endless belt, wherein the controller is configured to further execute a collection process in which the belt cleaner collects toner on the cleaning member via the photosensitive drum and the endless belt after the sheet has passed the conveyance nip.

8. The image forming apparatus according to claim 6, further comprising a plurality of cartridges and a plurality of toner supply members, wherein each of the plurality of cartridges includes one of the plurality of photosensitive drums and one of the plurality of toner supply members, wherein at least two of the plurality of cartridges includes a cleaning member, wherein the toner supply process, the output process, and the sheet feeding process are executed for each of the at least two of the plurality of cartridges.

9. The image forming apparatus according to claim 1, further comprising a first transfer roller and a second transfer roller, wherein the image bearing member includes an endless belt, wherein the conveyance member includes a first photosensitive drum, wherein the toner supply member includes a second photosensitive drum, wherein the first transfer roller pinches the endless belt with the first photosensitive drum, and the second transfer roller pinches the endless belt with the second photosensitive drum.

10. The image forming apparatus according to claim 9, wherein the controller is configured to further execute an application process to apply a voltage having a polarity same as that of toner to the first transfer roller in at least a period of time in which the sheet passes the conveyance nip.

11. The image forming apparatus according to claim 9, wherein the first photosensitive drum and the second photosensitive drum are arranged in a conveyance direction in which the sheet is conveyed, the first photosensitive drum is positioned upstream of the second photosensitive drum in the conveyance direction, wherein the first transfer roller and the second transfer roller are arranged in the conveyance direction, the first transfer roller is positioned upstream of the second transfer roller in the conveyance direction, wherein the toner supply process is executed by using the second photosensitive drum and the second transfer roller, wherein the sheet feeding process is executed based on a conveyance nip formed by the first photosensitive drum and the endless belt.

12. An image forming apparatus comprising:

a photosensitive drum configured to carry toner;

a developing roller configured to supply the photosensitive drum with the toner;

a transferring unit in contact with the photosensitive drum at a transferring nip, the transferring unit being configured to transfer a toner image from the photosensitive drum to a sheet at the transferring nip;

a cleaning roller in contact with the photosensitive drum to form a collection nip, the cleaning roller being configured to collect toner from the photosensitive drum at the collection nip;

a circuit configured to apply to the cleaning roller a cleaning voltage prompting the cleaning roller to collect toner;

a supply mechanism configured to start feeding a sheet to the transferring nip; and a controller configured to execute a maintenance mode in which the controller is configured to execute:

after the developing roller supplies a predetermined region of the photosensitive drum with toner, i) controlling the circuit to maintain a state where the circuit does not apply a voltage having a polarity opposite to toner to the transferring unit while the predetermined region of the photosensitive drum passes the transfer nip;

after executing the controlling i), ii) controlling the circuit to apply to the cleaning roller the cleaning voltage having a polarity opposite to toner while the predetermined region of the photosensitive drum passes the collection nip;

after executing the controlling ii), iii) controlling the supply mechanism to start feeding a sheet toward the transferring nip; and after executing the controlling iii), iv) controlling the circuit to apply a voltage having a polarity opposite to the toner to the transferring unit while the predetermined region of the photosensitive drum passes the transferring nip.

13. The image forming apparatus according to claim 12, wherein in the controlling iii), the controller controls the supply mechanism to start feeding the sheet at a timing so that the sheet reaches the transferring nip when the predetermined region of the photosensitive drum passes the transferring nip during execution of the controlling iv).

14. The image forming apparatus according to claim 12, wherein in the controlling ii), the controller controls the circuit to apply the cleaning voltage having a polarity the same as toner to the transferring unit.

* * * * *